US006430770B1

(12) United States Patent
Glass

(10) Patent No.: US 6,430,770 B1
(45) Date of Patent: Aug. 13, 2002

(54) PORTABLE GOLF CLUB HEAD CLEANING DEVICE

(76) Inventor: Greg T. Glass, 1300 W. Lynn St., Slaton, TX (US) 79364

( * ) Notice: Subject to any disclaimer, the term of this patent is extended or adjusted under 35 U.S.C. 154(b) by 26 days.

(21) Appl. No.: 09/734,257

(22) Filed: Dec. 11, 2000

(51) Int. Cl.[7] ..... A46B 11/00

(52) U.S. Cl. ..... 15/104.92; 15/160; 401/9; 401/10

(58) Field of Search ..... 15/104.92, 160; 401/9–11

(56) References Cited

U.S. PATENT DOCUMENTS

| | | | | | |
|---|---|---|---|---|---|
| 597,729 | A | * | 1/1898 | Mitchell | 15/104.92 |
| 1,085,249 | A | * | 1/1914 | Diven | 15/104.92 |
| 1,527,112 | A | * | 2/1925 | Blazer | 15/160 X |
| 2,478,522 | A | * | 8/1949 | Buskirk | 15/104.92 X |
| 2,629,124 | A | * | 2/1953 | Merritt | 15/104.92 X |
| 2,744,276 | A | * | 5/1956 | Chambless | 15/104.92 |
| 3,224,029 | A | * | 12/1965 | Domingos | 15/104.92 |
| 3,369,266 | A | * | 2/1968 | Willson | 15/104.92 |
| 3,583,018 | A | * | 6/1971 | Fink | 15/104.92 |
| 3,748,676 | A | * | 7/1973 | Warren et al. | 15/104.92 X |
| 3,994,040 | A | | 11/1976 | DiStefano | 15/236.06 |
| 4,091,489 | A | * | 5/1978 | Nimetz | 15/104.92 |
| 4,350,457 | A | | 9/1982 | Carnahan | 401/11 |
| D267,751 | S | | 1/1983 | Dobyns | D32/1 |
| 4,380,839 | A | * | 4/1983 | Caradonna | 15/104.92 |
| 4,384,384 | A | | 5/1983 | Trojohn | 15/146 |
| 4,464,072 | A | | 8/1984 | Norwell | 401/137 |
| 4,472,851 | A | | 9/1984 | Kinsey | 15/88.3 |
| D275,780 | S | | 10/1984 | Pearson | D21/795 |
| 4,571,767 | A | | 2/1986 | Dangler | 15/161 |
| 4,734,952 | A | | 4/1988 | Parchment et al. | 15/104.92 |
| 4,821,358 | A | * | 4/1989 | Wyckoff et al. | 15/104.92 |
| 4,872,235 | A | * | 10/1989 | Nielsen | 15/104.92 |
| D308,766 | S | | 6/1990 | Van Rensburg | D4/119 |
| 4,940,349 | A | | 7/1990 | Van Rensburg | 401/10 |
| 4,944,063 | A | | 7/1990 | Jordan | 15/104.92 |
| 4,951,339 | A | | 8/1990 | Braun | 15/88.3 |
| 4,965,906 | A | * | 10/1990 | Mauro | 15/104.92 |
| 5,054,153 | A | | 10/1991 | Silliman | 15/160 |
| 5,056,946 | A | | 10/1991 | Larkin | 401/11 |
| 5,081,735 | A | * | 1/1992 | Wyatt et al. | 15/104.92 |
| 5,155,883 | A | | 10/1992 | Legault | 15/21.2 |
| 5,195,743 | A | | 3/1993 | Walsh, Jr. | 473/401 |
| D350,630 | S | | 9/1994 | Smith | D32/1 |
| 5,385,160 | A | | 1/1995 | Brinkman | 134/186 |
| 5,404,610 | A | | 4/1995 | Coyer, Sr. et al. | 15/104.92 |
| 5,533,225 | A | * | 7/1996 | Ellis | 15/104.92 |
| 5,560,066 | A | | 10/1996 | McDivitt | 15/88.3 |
| 5,652,993 | A | * | 8/1997 | Kreyer | 15/104.92 |
| 5,666,684 | A | | 9/1997 | Cussen | 15/104.92 |
| D386,847 | S | | 11/1997 | Petrie | D32/35 |
| 5,732,435 | A | * | 3/1998 | Williams et al. | 15/104.92 |
| 5,742,965 | A | | 4/1998 | Leask | 15/21.1 |
| 5,787,539 | A | | 8/1998 | Nussbaum | 15/24 |
| 5,915,432 | A | | 6/1999 | Trummer | 15/23 |
| 5,983,432 | A | | 11/1999 | Jones | 15/21.2 |
| 6,021,537 | A | | 2/2000 | Smith | 15/21.2 |
| 6,041,795 | A | | 3/2000 | Steiner | 134/56 R |
| 6,269,512 | B1 | * | 8/2001 | Thomson et al. | 15/104.92 |

FOREIGN PATENT DOCUMENTS

| | | | | |
|---|---|---|---|---|
| NL | 57351 | * | 8/1946 | 15/104.92 |

* cited by examiner

*Primary Examiner*—Mark Spisich
(74) *Attorney, Agent, or Firm*—Gerald E. Helget; Nelson R. Capes; Briggs and Morgan

(57) ABSTRACT

A portable golf club cleaning device including a plastic bottle designed to contain a cleaning fluid, a threaded cover for the bottle having an opening and a removable snap on lid. Brushes attached to the cover extend partially into the fluid and surround the inside of the enclosure so that a golf club placed into the hole will be scrubbed by the brushes and washed by the cleaning fluid. The brushes are limited in deflection due to the insertion of the golf club between the brushes, by mounting opposite facing pairs of continuous scrubbing of the golf club. The snap on lid will allow portability without spillage.

14 Claims, 4 Drawing Sheets

PORTABLE GOLF CLUB HEAD CLEANING DEVICE

BACKGROUND OF THE INVENTION

1. Field of the Invention

The invention related generally to a device for cleaning golf clubs and more specifically to a device that is portable, compact and provides cleaning means to any size or shape club, easily and conveniently.

2. Description of the Prior Art

Every sport has it's subtleties which can help or hinder a player depending on how well a player knows, understands, and uses them to his/her advantage. One such subtlety in the game of golf is that a golf ball will travel further when hit with a club having clean grooves, all other factors being equal, of course. A golf club in use tends to acquire dirt, mud, and/or grass by virtue of its proximity and contact with the ground during play. It is desirable then, for golfers to have hand-held portable cleaners with them at all times, thus allowing players to clean their clubs during play.

Devices for cleaning golf clubs have been in use for a period of time, but all have common shortcomings in that they are bulky, cumbersome and not easily portable to golfers. With the existing club cleaning devices it is impractical and difficult to clean a club after every shot. The devices are simply not designed to handle "on the spot" cleaning of the clubs. Therefore, clubs are usually only cleaned when the player returns to the clubhouse or home.

The prior art shows examples of golf-club devices, none of which will allow the cleaning of clubs with a hand-held apparatus. For example, U.S. Pat. No. 4,734,952 issued Apr. 5, 1988 to Parchment, et al. shows a container for mounting on the rear of a golf cart containing brushes and a flap to prevent the cleaning solution from spilling. Design patents U.S. Pat. Des. No. 267,751 issued Jan. 25, 1983 to Dobyns and U.S. Pat. Des. No. 308,766 issued Jun. 26, 1990 to Van Rensburg show golf club cleaners which fail to anticipate the device disclosed herein.

SUMMARY OF THE INVENTION

The invention provides a convenient and inexpensive means for cleaning golf clubs of all shapes and sizes that is portable and easily serviced. Accordingly these are among the objects of the invention.

Utilizing a plastic container that may be transported by golfers throughout the golf course during play. Both the plastic container and its cover have threaded sections allowing a secure connection by screwing the cover on. The cover of the container is also designed to have a secure snap on tight fitting lid that will not disengage from the container accidentally. Attached to the inside surface of the cover are two intertwined brushes running parallel relative to each other. The brushes are of sufficient length that when mounted by their longitudinal axis, they will extend into the cleaning fluid within the cylindrical plastic container. The cover contains one opening, circular in shape. The opening is restricted in part by the brushes whose bristles face each other and actually engage and scrub the golf club within and out of the cleaning liquid. The opposite pairs of brushes allow for separation when the golf club is inserted for cleaning. The cover also contains a flexible membrane located approximately ¼" (6.35 mm) from the top of the cover. The flexible membrane is bisected to allow passage of golf clubs and aids in preventing the cleaning liquid from splashing out of the container. While not in use, the flexible membrane and the snap on lid form a seal to prevent spillage of cleaning liquid. The circular opening within the cover is designed to accommodate any size club.

The cleaning liquid, which may be simply soap and water, is easily changed by merely removing the cover by unscrewing the cover from the container and pouring out the liquid within. The brushes are attached to the cover as to form a singular piece, which can be easily cleaned or replaced if necessary. Both the brushes and flexible membrane form a barrier preventing the splashing of cleaning liquid when in use. The snap on lid and membrane ensure the prevention of spillage in the event of accidental vibration or jarring of the container. A ridge around the circumference of the container above the flexible membrane retains cleaning liquid dripping from the club after cleaning and allows this liquid to drain back into the container.

It is therefore an object of the invention to provide a new and improved handheld, compact, portable golf club scrubber.

It is another object of the invention to provide a new and improved golf club scrubber that will clean clubs of all shapes and sizes.

It is a further object of the invention to provide a new and improved golf club scrubber that is convenient and economical.

It is still another object of the invention to provide a new and improved golf club scrubber that is of durable and reliable construction.

It is yet another object of the invention to provide a new and improved golf club scrubber that is portable and may be easily attached to golf bags or carts.

It is still a further object of this invention to provide a new and improved golf club scrubber that may be easily and efficiently manufactured and marketed.

These and other advantages, features and objects of the invention will become more apparent from the following description taken in connection with the illustrative embodiment in the accompanying drawings.

DESCRIPTION OF THE PREFERRED EMBODIMENT

Figure 1:
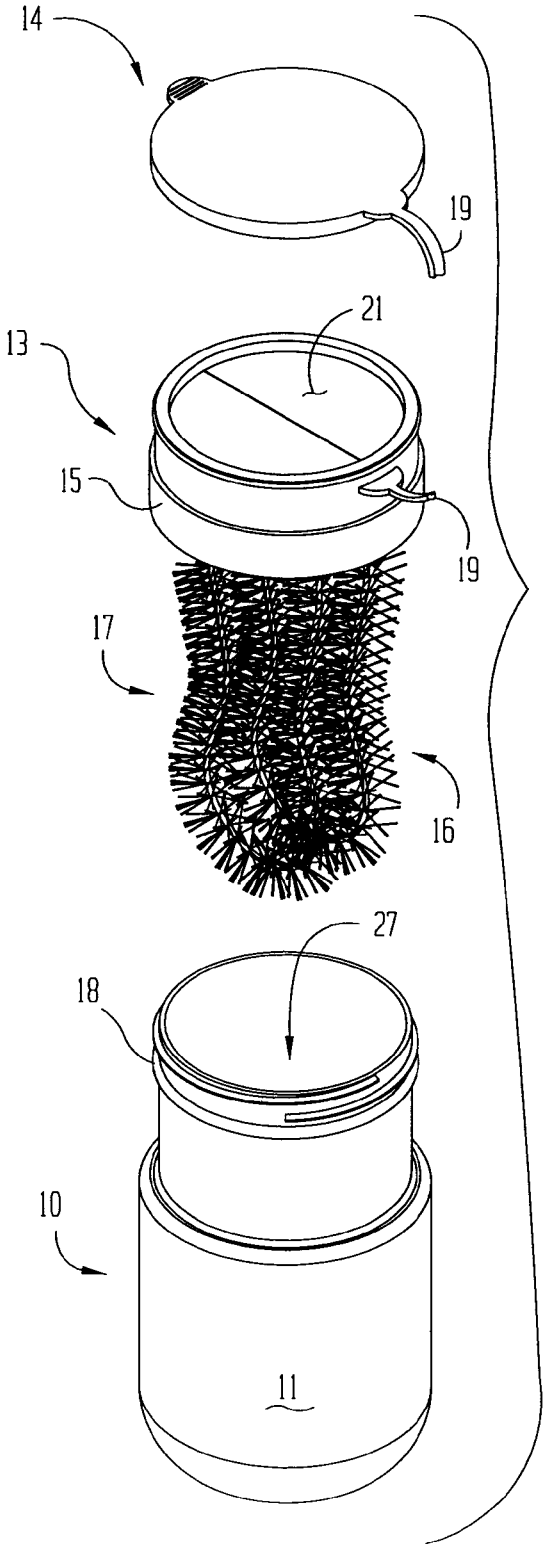
FIG. 1 is a perspective exploded view of the cleaning device as embodied in the subject invention and illustrates the main components of the device.
Figure 2:
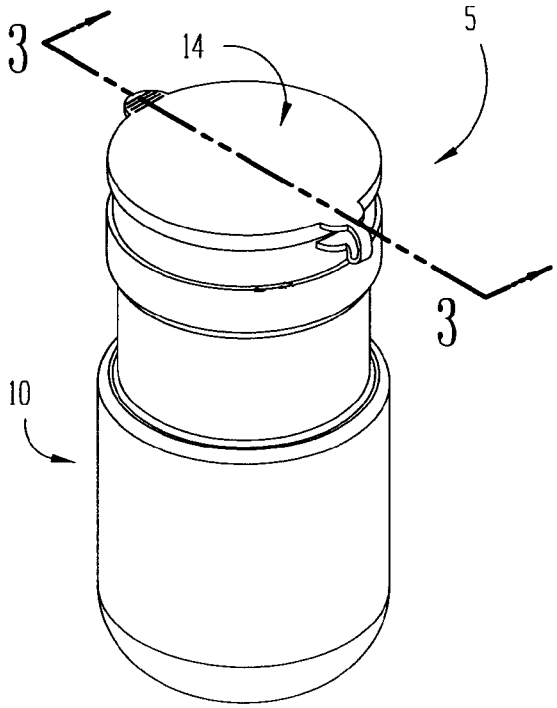
FIG. 2 is a perspective view of the cleaning device as embodies in the subject invention and illustrated the device when sealed.

Referring to the drawings and particularly to FIGS. 1 and 2, the cleaning device embodied in the subject invention is generally indicated at 5. The cleaning device 5 includes a housing that is defined by a preferably cylindrical container generally indicated at 10. The container 10 is preferably formed of a suitable rigid plastic material and can be constructed by any suitable means to define an interior chamber generally indicated at 27 and a rigid wall 11. Formed around the circumference in the upper portions of the container 10 is a threaded portion 18 that is designed to fit with the lid generally indicated at 13.

Figure 3:
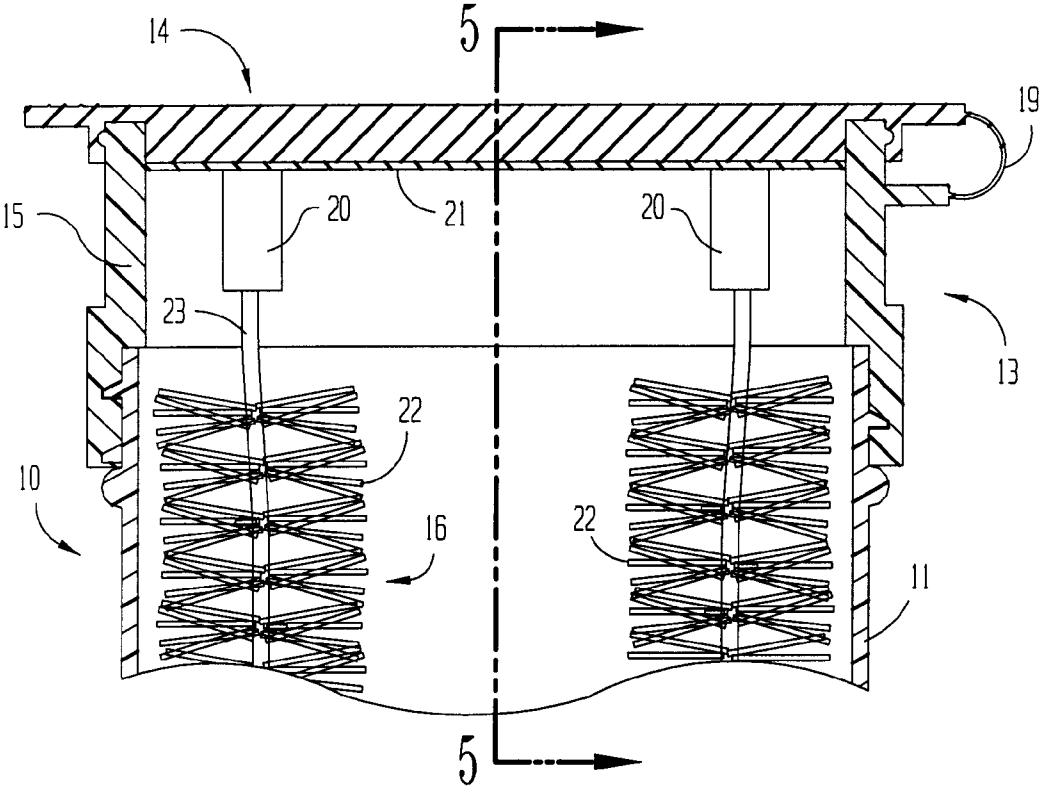
FIG. 3 is a sectional view taken along line 3—3 in FIG. 2 with portions broken away to illustrate the positions and locations of the brushes, lid, flexible membrane, cover and container when the cleaning device is not in use.
Figure 5:
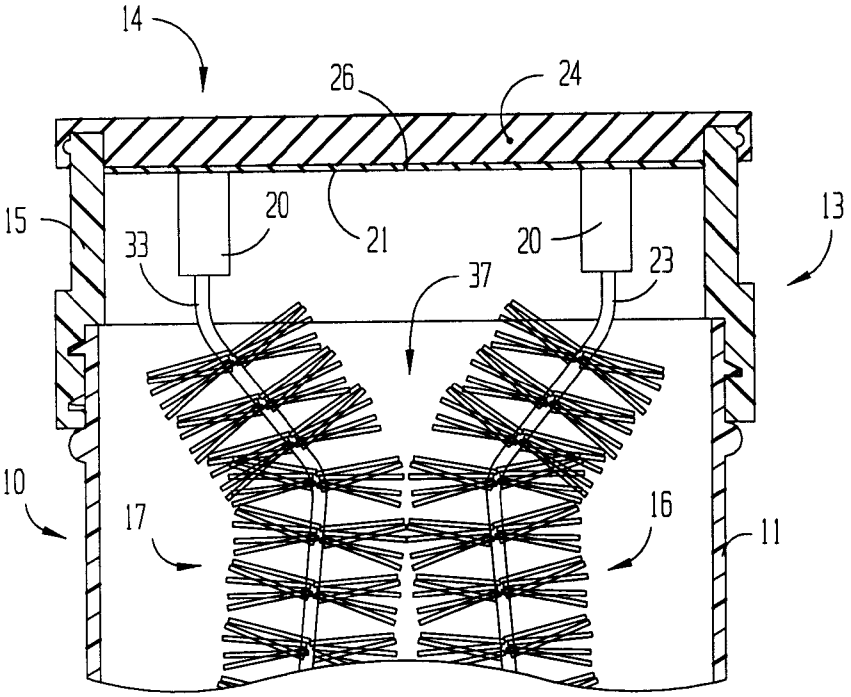
FIG. 5 is a sectional view taken along line 5—5 in FIG. 3 showing the locations and positions of the brushes, lid, flexible membrane, cover and container when the cleaning device is not in use.
Figure 8:
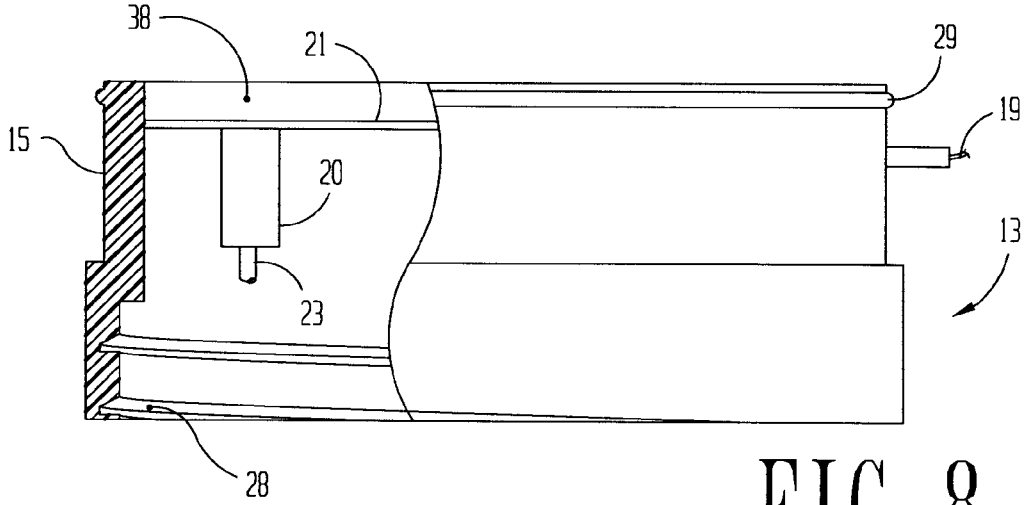
FIG. 8 is a side elevation of the cover with portions being broken away to show the interior particulars of the cover.

Referring now to FIGS. 3, 5 and 8, the cleaning device 5 also includes a cover generally indicated at 13. The cover is preferably formed of a suitable rigid plastic material and can be constructed by any suitable means to define an exterior cylindrical wall 15, a threaded groove 28, four wire guides 20, a plurality of brushes 16 and 17, and a thin flexible membrane 21.

Attached within the cover 13 are a plurality of brushes generally indicated at 16 and 17. These brushes are mounted within the wire guides 20 and are placed in a manner in which the brushes lie both parallel and opposite of each other, forming a small gap generally indicated at 37, through which a golf club generally indicated at 25 is to pass. The brushes 16 and 17 are constructed of a wire harness 23 and 33, throughout which evenly spaced bristle clusters 22 are located. The brushes 16 and 17 are to be considered to be a part of 13, thus forming a singular entity.

Referring now to FIGS. 3, 5 and 8, the cleaning device 5 also includes a lid generally indicated at 14. The lid is preferably formed of a suitable rigid plastic material and can be constructed by any suitable means to define a preferably circular shaped top 35, a smaller preferably cylindrically shaped outer wall 36 located beneath top, a preferably circular shaped plug section 24, and a contoured inside wall 34 designed to fit firmly onto the preferably cylindrical container 10.

As described above, the subject invention is designed to effectively clean golf clubs 25. In order to provide effective cleaning the cylindrical container 11 must contain a quantity of cleaning liquid 30 illustrated in FIG. 4.

Figure 7:
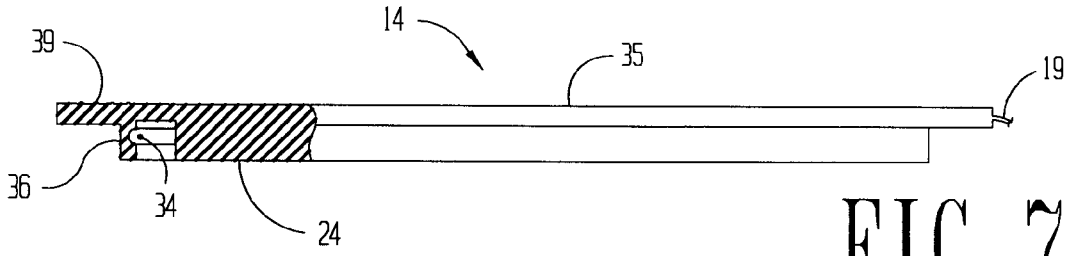
FIG. 7 is a side elevation of the lid with portions being broken away show the interior workings of the lid.

Prior to use of the device in a cleaning operation, a quantity of cleaning liquid 30 must lie within the container 10. The cover 13 is then to be firmly attached to the container 10 by means of a threaded section 18 shown in FIG. 1 and a threaded groove 28 located within the cover 13 as seen in FIG. 8. As illustrated in FIG. 3 the lid 14 fastens to cover 13 utilizing a shaped groove 34 shown in FIG. 7 designed to accommodate a lip 29 illustrated in FIG. 8. As illustrated in FIG. 7, the lid 14 contains a circular shaped plug section 24 designed to fit within the aperture 38 of cover 13.

Referring now to FIGS. 3 and 5, prior to use in a cleaning operation the lid 14 and cover 13 form a seal whereas the plug section 24 of the lid 14 and the flexible membrane 21 found within cover 13 seal with one another. As is shown in FIG. 3, the lid 14 is secured upon the cover 13 by means of a specially designed groove 34 specifically designed to accommodate the uppermost portion and protruding lip 29 of the cover 10.

Figure 9:
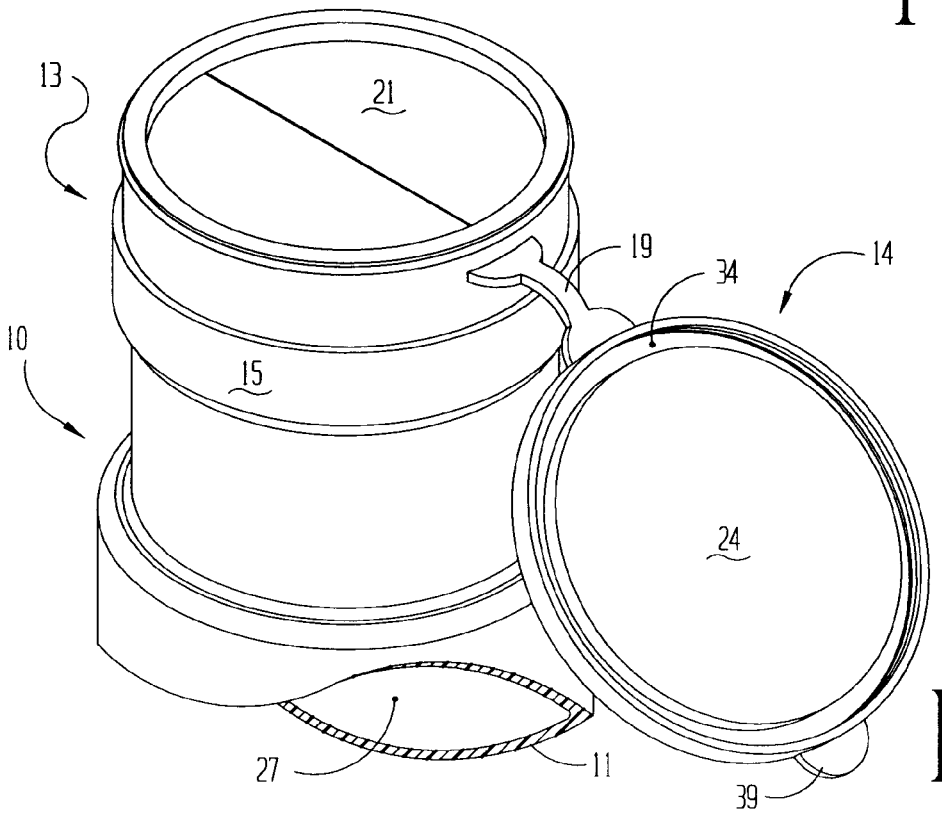
FIG. 9 is a perspective view of the cleaning device as embodied in the subject invention with portions being broken away to illustrate the lid in relation to the cover whereas the lid is disengaged from the cover.

Immediately prior to use of the device in a cleaning operation, the lid 14 must be removed from the cover 13 by firmly pressing down on the lid top indicated by 35 in FIG. 7 and pulling in an upwardly fashion on the lid tab indicated by 39 in FIG. 7. The lid 14 is then lifted away from the cover 13 and is maintained connected by a connecting strap indicated by 19 in FIG. 9. The lid 14 proximal to the cover 13 when disengaged.

Figure 4:
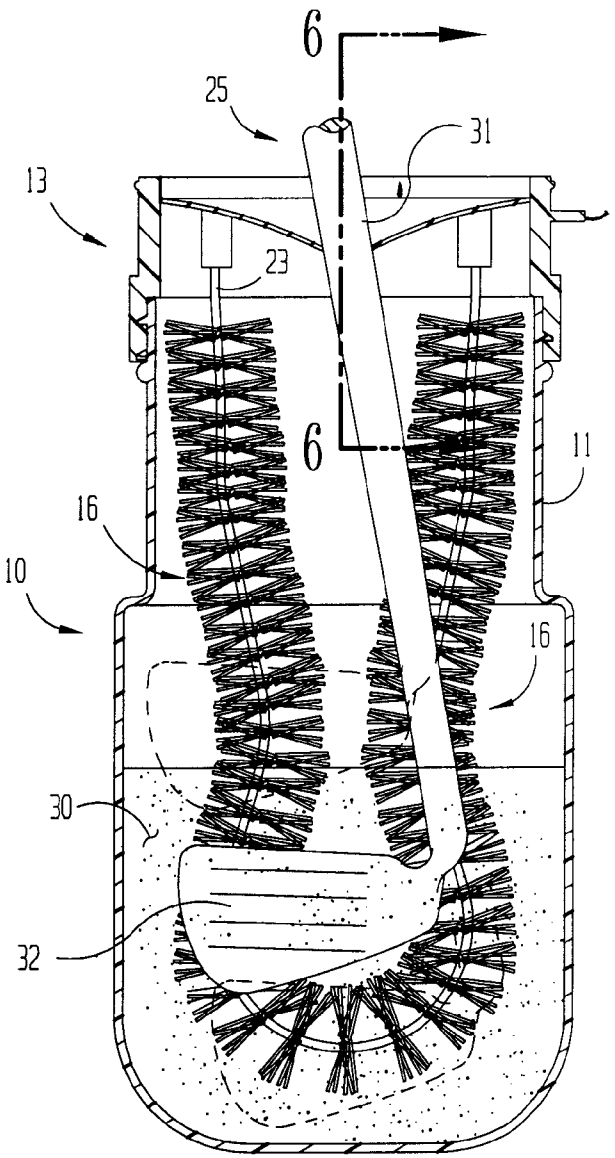
FIG. 4 is a sectional view taken along a line identical to line 3—3 in FIG. 2 which illustrates the cleaning device with a portion broken away to show the position and motion of a golf club within the container during cleaning.
Figure 6:
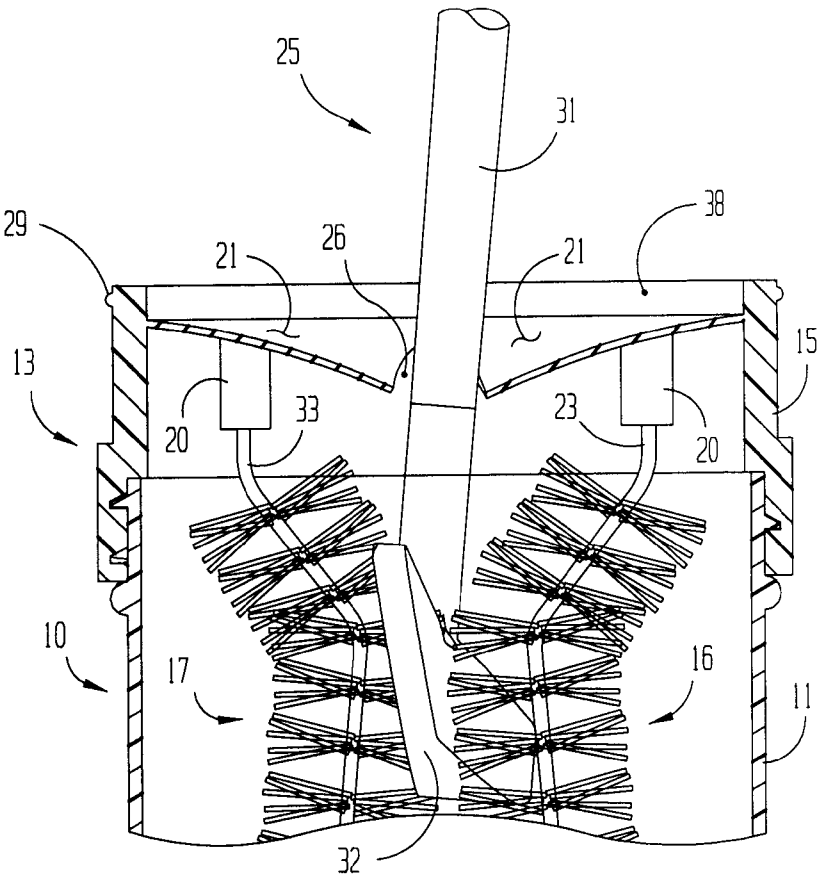
FIG. 6 is a sectional view taken along line 6—6 in FIG. 4 showing the locations and positions of the brushes, lid, flexible membrane, cover and container as a golf club enters the container.

Referring to the drawings and particularly to FIGS. 4 and 6, in the use of the device for cleaning the face of a golf club generally indicated by 25, a club head indicated at 32 is inserted through the cover 13. The golf club is to be gripped by the club shaft indicated by 31 while being introduced to the cleaning device. The club head 32 passes though the cover 13 aperture 38 by extending the flexible membrane 21 along a bisecting cleft 26 which permits distention to allow the full introduction of the club head 32 into the cleaning device.

As further illustrated in FIGS. 4, 5 and 6, a golf club 25 is inserted through the aperture 38 of the cover and is introduced into the container 10 in a generally vertical direction between brushes 16 and 17 in the area generally indicated by 37 in FIG. 5. The user of the device then raises and lowers the club 25 in a generally vertical motion, engaging contact between the club head 32 and brushes 16 and 17. As the club 25 is inserted in a manner illustrated in FIG. 4 the club head 32 is immersed into the cleaning solution indicated by 30. The club head 32 undergoes the cleaning action upon engaging the brushes 16 and 17 whereas the club head 32 presses the brush wires 23 and 33 apart and is scrubbed by the brush bristles 22. The user moves the shaft 31 of the club 25 in a generally vertical direction, as seen in FIG. 4. The cleaning operation actually is accomplished in a matter of seconds as the club head is moved up and down in a generally vertical motion within the container 10 as the brush members 16 and 17 scrub the club head 32 while in the cleaning solution 30 or within the interior chamber 27. By utilizing a cleaning fluid such as water or other liquid introduced into the interior chamber 27 as the club head 32 is inserted the swirling and churning motions of the liquid lends itself to a more thorough scrubbing action of the club head. Thus, as the brush members 16 and 17 and cleaning liquid 30 engage the surfaces of the club head 32, debris and dirt as removed from the club head are trapped within the cleaning liquid 30 and within the brushes themselves. It is therefore seen that the brush members 16 and 17 cooperate with the cleaning liquid 30 in the interior chamber 27 to thoroughly clean the club head easily within a relatively short period of time.

The cover 13 may be simply removed from the container 10, preferably by unscrewing the cover 13 from the container 10. As the brushes 16 and 17 are attached to the cover, they are also simply removed from the container with the cover, allowing access to the brushes for, example, cleaning and air drying. The cleaning fluid and all suspended dirt may be removed from the container by simply inverting the container and dumping the fluid and dirt out. Because there is no need for a drain, there is less likelihood of a drain being clogged by the suspended dirt. Also, when the brushes are removed from the container, the container's interior chamber 27 may be wiped out.

While there is shown and described herein certain specific structure embodiments in the invention, it may be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A portable cleaning device for golf clubs comprising:

(a) a container having a bottom wall, side walls, and an open top, the bottom wall and sidewalls defining an interior chamber;

(b) a cover removably attached to the container about the open top, the cover having an aperture therethrough and a flexible membrane spanning the aperture, the cover being removable from the container without the use of tools;

(c) a first cleaning member attached to the cover and extending into the interior chamber and the cleaning member being removable from the container with the cover;

(d) said flexible membrane having a second aperture therethrough adapted to allow passage of a golf club head; and (e) a lid removably attached to the cover;

whereby fluid may be introduced into the container, a golf club head inserted through the second aperture and first aperture into the interior chamber, the golf club head being cleaned by scrubbing the golf club head against the cleaning member, and the cover may be removed to permit cleaning of the cleaning member outside the container and removal and replacement of the cleaning fluid.

2. The portable cleaning device of claim 1, further comprising a second cleaning member parallel to the first cleaning member and the second cleaning member being attached to the cover, the first cleaning member and second cleaning member being adapted to receive a golf club head therebetween.

3. The portable cleaning device of claim 2, wherein the first cleaning member and second cleaning member are brushes.

4. The portable cleaning device of claim 1, wherein the cover further comprises a first thread, the container further comprises a matching second thread, and the cover threadably engages the container.

5. The portable cleaning device of claim 1, wherein the container is cylindrical.

6. The portable cleaning device of claim 1, wherein the lid snaps onto the cover.

7. The portable cleaning device of claim 6, further comprising a retaining strap securing the lid to the cover after the lid is unsnapped from the cover.

8. A portable cleaning device for golf clubs comprising:

(a) a container having a bottom wall, side walls, and an open top, the bottom wall and sidewalls defining an interior chamber;

(b) a cover removably attached to the container about the open top, the cover having an aperture therethrough and a flexible membrane spanning the aperture, the cover being removable from the container without the use of tools;

(c) a first cleaning member attached to the cover and extending into the interior chamber and the cleaning member being removable from the container with the cover, a second cleaning member parallel to the first cleaning member and the second cleaning member being attached to the cover, the first cleaning member and second cleaning member being adapted to receive a golf club head therebetween;

(d) said flexible membrane having a second aperture therethrough adapted to allow passage of a golf club head; and (e) a lid removably attached to the cover whereby fluid may be introduced into the container, a golf club head inserted through the second aperture and first aperture into the interior chamber, the golf club head being cleaned by scrubbing the golf club head against the cleaning members, and the cover may be removed to permit cleaning of the cleaning members outside the container and removal and replacement of the cleaning fluid.

9. The portable cleaning device of claim 8, wherein the first cleaning member and second cleaning member are brushes.

10. The portable cleaning device of claim 8, wherein the cover further comprises a first thread, the container further comprises a matching second thread, and the cover threadably engages the container.

11. The portable cleaning device of claim 8, wherein the container is cylindrical.

12. The portable cleaning device of claim 8, wherein the lid snaps onto the cover.

13. The portable cleaning device of claim 12, further comprising a retaining strap securing the lid to the cover after the lid is unsnapped from the cover.

14. A portable cleaning device for golf clubs comprising:

(a) a cylindrical container having a bottom wall, side walls, and an open top, the bottom wall and sidewalls defining an interior chamber;

(b) a screw-on cover removably attached to the container about the open top, the cover having an aperture therethrough and a flexible membrane spanning the aperture, the cover being removable from the container without the use of tools;

(c) at least one pair of brushes attached to the cover and extending into the interior chamber and being removable from the container with the cover, and being adapted to receive a golf club head therebetween;

(d) the flexible membrane having a second aperture therethrough adapted to allow passage of a golf club head; and (e) a lid removably attached to the cover wherein the lid snaps onto the cover and further comprising a retaining strap securing the lid to the cover after the lid is unsnapped from the cover;

whereby fluid may be introduced into the container, a golf club head inserted through the second aperture and first aperture into the interior chamber, the golf club head being cleaned by scrubbing the golf club head against the brushes, and the cover may be removed to permit cleaning of the brushes outside the container and removal and replacement of the cleaning fluid.

* * * * *